United States Patent [19]

Chawla et al.

[11] Patent Number: 4,669,384

[45] Date of Patent: Jun. 2, 1987

[54] HIGH TEMPERATURE SHAPED CHARGE PERFORATING APPARATUS

[75] Inventors: Manmohan S. Chawla, Houston; William A. McPhee, Jersey Village, both of Tex.

[73] Assignee: Dresser Industries, Inc., Dallas, Tex.

[21] Appl. No.: 814,819

[22] Filed: Dec. 30, 1985

[51] Int. Cl.[4] ..... F42B 1/02

[52] U.S. Cl. ..... 102/307; 102/309; 102/476; 102/310; 175/4.6

[58] Field of Search ..... 102/306–310, 102/476; 175/4.6

[56] References Cited

U.S. PATENT DOCUMENTS

| | | | |
|---|---|---|---|
| 2,649,046 | 8/1953 | Davis | 102/312 X |
| 2,734,456 | 2/1956 | Sweetman | 89/1.15 X |
| 2,760,434 | 8/1956 | Ruth | 102/306 |
| 2,782,715 | 2/1957 | Udry | 102/306 X |
| 2,796,022 | 6/1957 | Delacour | 102/306 |
| 3,276,369 | 10/1966 | Bell | 102/24 |
| 3,374,737 | 3/1968 | Pike | 102/307 X |
| 3,561,361 | 2/1971 | Kessenich et al. | 102/24 |
| 4,148,257 | 4/1979 | Orrill et al. | 102/307 X |
| 4,184,430 | 1/1980 | Mock | 102/307 |
| 4,387,773 | 6/1983 | McPhee | 175/4.6 |
| 4,428,440 | 1/1984 | McPhee | 175/4.6 |
| 4,466,353 | 8/1984 | Grace | 102/307 |
| 4,519,313 | 5/1985 | Leidel | 102/307 X |

*Primary Examiner*—Peter A. Nelson

*Attorney, Agent, or Firm*—Patrick H. McCollum

[57] ABSTRACT

A shaped charge perforating unit includes a housing having a cavity formed therein. An explosive charge of high explosive material is retained within the cavity by a liner of non-explosive material. The explosive charge consists of quantities of two explosive materials having different detonation sensitivities.

4 Claims, 1 Drawing Figure

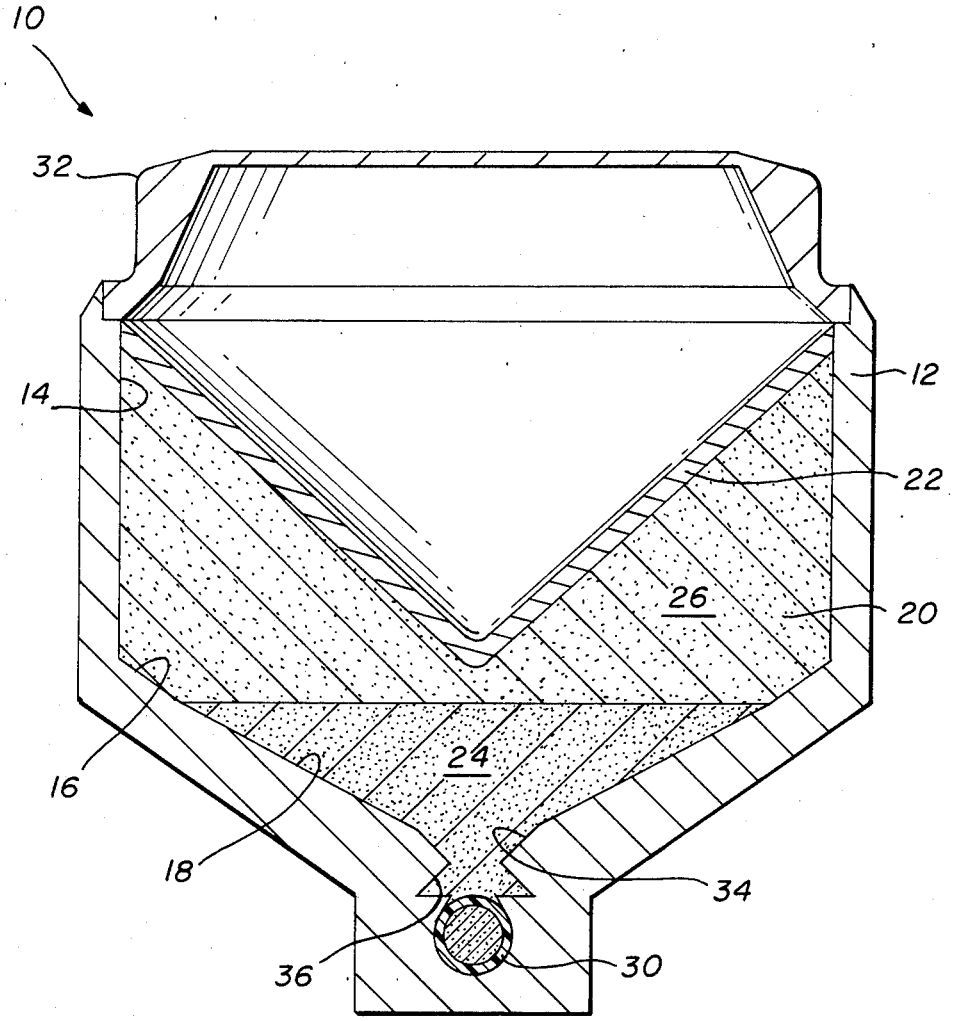
10
32
14
12
22
26
20
24
16
18
34
36
30

HIGH TEMPERATURE SHAPED CHARGE PERFORATING APPARATUS

BACKGROUND OF THE INVENTION

This invention relates in general to shaped charge perforators and more particularly, to a high temperature shaped charge perforating unit having two high explosive materials.

Explosive shaped charge well perforating devices are often used in perforating well casing and the surrounding earth formations in the production of hydrocarbons. In a typical embodiment, a plurality of shaped charges are mounted in a fluid-tight, cylindrical, metal housing or on an elongated bar member which is adapted to traverse the borehole to be perforated. The shaped charges are mounted in the housing or on the bar member at longitudinally spaced intervals, with their axis of perforating directed generally laterally thereof. A more detailed description of a typical perforating apparatus is contained in U.S. Pat. No. 4,428,440, which is incorporated herein by reference.

The shaped charge most common in well perforating is a conical shaped charge. A conical shaped charge consists of an explosive material having a substantially conical cavity formed in the front face. A metal liner material covers the face of the cavity. Upon detonation the shape of the explosive cavity focuses and propagates a progressive wave front against the outside surface of the metal line. At the pressures generated the metal acts as a fluid. Metal in fluid form is focused into a "jet" stream. The resultant focusing force moves particles to form a jet which lengthens as the wave front advances from apex to base of the conical cavity. The extreme high pressure, particle laden, jet stream breaks down and moves aside any material upon which it impinges. Penetration of such material is a result of the amount of pressure and the kinetic energy in the jet stream. One form of conical shaped charge used in well perforating is illustrated in U.S. Pat. No. 4,387,773, which is incorporated herein by reference.

The present invention provides method and apparatus for perforating a well casing and the surrounding formations in a high temperature environment, above 500° F., using a lined shaped charge employing an explosive material consisting of quantities of two explosive materials having different detonation sensitivities.

SUMMARY OF THE INVENTION

A shaped charge perforating unit comprises a charge case or housing with an internal cavity formed therein. An explosive charge of high explosive material conforms an exterior shape with the inside of the cavity and is retained in place by a liner of non-explosive material. The explosive material comprises quantities of two high temperature explosive materials, one having a relatively high detonation sensitivity and the other having a relatively low detonation sensitivity.

BRIEF DESCRIPTION OF THE DRAWING

The FIGURE is a longitudinal, cross-section of a shaped charge unit in accordance with the present invention.

DETAILED DESCRIPTION OF A PREFERRED EMBODIMENT

Referring now to the FIGURE, there is illustrated a lined shaped charge unit 10 adapted for use in a perforating gun for perforating oil well casing and the surrounding formations. The housing or shell 12 may be made of any suitable material, such as, for example steel. Housing or shell 12 may have any one of numerous outside configurations as is common in the art, for example a generally uniform outside diameter or a frustoconical appearance.

The cavity formed in the interior of housing 12 may be conical, hemispherical or other suitable configuration. As illustrated in the FIGURE, the cavity has a generally cylindrical forward end portion 14, a tapered, intermediate portion 16 and an apex with a reduced rear end extension 18. Rear end extension 18 comprises an inwardly tapered first portion 34 and an outwardly tapered second portion 36. The explosive charge comprises a tubular or annulus shaped body of high explosive material 20, conforming in exterior shape with the shape of the inner surface of the cavity formed within housing 12. A liner 22 retains the explosive charge within housing 12. Liner 22 is illustrated as conical in shape, however, it should be recognized that it could be of other suitable shapes, for example hemispherical. Liner 22 is constructed of a suitable non-explosive material, preferably having a relatively high density, such as, for example copper.

In the illustrated embodiment explosive material 20 consists of quantities of two high explosives having different detonation sensitivies. A quantity of a first high temperature, high explosive material 24 fills rear end portion 18 including inwardly tapered first portion 34 and outwardly tapered second portion 34. The remainder of the cavity, comprising forward end portion 14 and intermediate portion 16, contain a quantity of a second high temperature, high explosive material 26 having a detonation sensitivity differing from that of first explosive material 24. Explosive material 20 should consist of a relative distribution of one-third or less of first explosive material 24 with the remainder comprising second explosive material 26.

In one embodiment of the present invention first explosive material 24 is an explosive having a relatively high detonation sensitivity. Such explosive will have an impact sensitivity in a range less than 30 cm. Examples of suitable explosive materials are hexanitrostilbene, commonly referred to as HNS. Other suitable first explosive materials are Picryl Sulfone and PYX. HNS, at a density of 1.70, has an impact sensitivity of 28 cm. In this embodiment the second explosive material 26 is an explosive having a relatively low impact sensitivity. Such explosive will have an impact sensitivity in a range greater than 300 cm. Examples of suitable explosive materials are diamenotrinetrobenzene, commonly referred to as DATB, or Triaminotrinitro Benzene, commonly referred to as TATB. DATB, at a density of 1.6, has an impact sensitivity greater than 360 cm.

Proximate the rear portion of the first explosive material 24 is located a high temperature detonating fuse 30. Detonating fuse 30 is a conventional detonator such a 80–100 grain high temperature detonating cord. A port plug or sealing member 32 is affixed to housing 12 to provide a fluid tight seal. Port plug 32 is formed with a relatively thin end wall positioned substantially in alignment with the axis of symmetry, the perforating axis, of the shaped charge unit.

In the operation of the invention, detonator fuse 30 is detonated by an ignitor or blasting cap (not shown). Detonator fuse 30 will detonate explosive material 20.

A detonation wave thus caused travels forwardly and strikes the apex of liner 22. The wavefront continues to travel forwardly through the main explosive material section, simultaneously collapsing liner 22 symmetrically inwardly about the axis of liner 22 causing the inner surface of liner 22 to flow and form part of a jet stream. The liner material upon arrival at the axis of symmetry separates into a fast moving jet carrying most of the particles.

The detonation wavefront impacting liner 22 can be tailored by altering the design of the interface between first explosive material 24 and second explosive material 26. If the interface between first explosive material 24 and second explosive material 26 is convex, the detonation waves can be made to arrive simultaneously at the apex of liner 22 providing a jet tip which is produced by implosion. Conventional initiation is produced by a flat interface between the two explosive materials, 24 and 26.

Many modifications and variations besides those specifically mentioned may be made in the techniques and structures described herein and depicted in the accompanying drawing without departing substantially from the concept of the present invention. Accordingly, it should be clearly understood the form of the invention described and illustrated herein is exemplary only, and is not intended as a limitation on the scope of the present invention.

The embodiments of the invention in which an exclusive property or privilege is claimed are defined as follows:

1. A high temperature explosive shaped charge comprising:

a housing having a forwardly opening cavity formed therein:

a quantity of explosive material within said cavity, said quantity of explosive material comprising first and second explosive materials having different detonation sensitivities wherein said first explosive material comprises an explosive material selected from a first group having a relatively high detonation sensitivity, said first explosive material having an impact sensitivity in a range less and 30 cm, and said second explosive material comprises an explosive material selected from a second group having a relatively low detonation sensitivity, said second explosive material having an impact sensitivity in a range greater then 300 cm;

a liner cooperatively arranged to retain said explosive material in said cavity.

2. The explosive shaped charge of claim 1 wherein said first explosive material comprises an explosive material selected from the group consisting of HNS, PYX and Picryl Sulfone.

3. The explosive shaped charge of claim 2 wherein said second explosive material comprises an explosive material selected from the group consisting of DATB and TATB.

4. The explosive shaped charge unit of claim 1 wherein said first explosive material comprises approximately one-third of said quantity of explosive material and said second explosive material comprises approximately two-thirds of said quantity of explosive material.

* * * * *